US011691421B2

(12) United States Patent
O'Reilly et al.

(10) Patent No.: US 11,691,421 B2
(45) Date of Patent: Jul. 4, 2023

(54) THERMAL BEND ACTUATOR HAVING IMPROVED LIFETIME

(71) Applicant: Memjet Technology Limited, Dublin (IE)

(72) Inventors: Rónán O'Reilly, Dublin (IE); Misty Bagnat, Dublin (IE); Owen Byrne, Dublin (IE); Alexandra Barczuk, Dublin (IE); Michael Shnider, San Diego, CA (US); Darren Hackett, Dublin (IE); Brian Kevin Donohoe, Dublin (IE); Kimberly G. Reid, San Diego, CA (US)

(73) Assignee: Memjet Technology Limited

( * ) Notice: Subject to any disclaimer, the term of this patent is extended or adjusted under 35 U.S.C. 154(b) by 0 days.

(21) Appl. No.: 17/586,097

(22) Filed: Jan. 27, 2022

(65) Prior Publication Data

US 2022/0242122 A1 Aug. 4, 2022

Related U.S. Application Data

(60) Provisional application No. 63/143,681, filed on Jan. 29, 2021.

(51) Int. Cl.
*B41J 2/14* (2006.01)
*B41J 2/16* (2006.01)

(52) U.S. Cl.
CPC ..... *B41J 2/14427* (2013.01); *B41J 2/1648* (2013.01); *B41J 2002/14435* (2013.01); *B41J 2202/03* (2013.01)

(58) Field of Classification Search
CPC ..... B41J 2/14048; B41J 2/14427; B41J 2002/14177; B41J 2002/14193; B41J 2002/14435; B41J 2002/14443; B41J 2/1648; B41J 2202/03; B41J 2202/15
See application file for complete search history.

(56) References Cited

U.S. PATENT DOCUMENTS

| | | | | |
|---|---|---|---|---|
| 7,073,890 | B2 * | 7/2006 | Cabal | B41J 2/14427 347/54 |
| 7,984,973 | B2 * | 7/2011 | McAvoy | B41J 2/14427 347/56 |
| 7,992,969 | B2 * | 8/2011 | Tanaka | B41J 2/14233 347/68 |
| 2016/0129688 | A1 * | 5/2016 | Lawlor | B41J 2/04591 347/11 |

* cited by examiner

*Primary Examiner* — Kristal Feggins
(74) *Attorney, Agent, or Firm* — Cooley LLP

(57) ABSTRACT

A thermal bend actuator includes: a thermoelastic beam for connection to drive circuitry; and a passive beam mechanically cooperating with the thermoelastic beam, such that when a current is passed through the thermoelastic beam, the thermoelastic beam expands relative to the passive beam resulting in bending of the actuator. The thermoelastic beam wherein the thermoelastic beam is comprised of an aluminium alloy. The aluminium alloy comprises a first metal which is aluminium, a second metal, and at least 0.1 at. % of a third metal selected from the group consisting of: copper, scandium, tungsten, molybdenum, chromium, titanium, silicon and magnesium.

17 Claims, 2 Drawing Sheets

THERMAL BEND ACTUATOR HAVING IMPROVED LIFETIME

CROSS REFERENCE TO RELATED APPLICATIONS

This application claims priority to and the benefit of U.S. Provisional Patent Application No. 63/143,681, entitled THERMAL BEND ACTUATOR HAVING IMPROVED LIFETIME, filed on Jan. 29, 2021, the disclosure of which is incorporated herein by reference in its entirety for all purposes.

FIELD OF THE INVENTION

This invention relates to MEMS thermal bend actuators, such as those configured for use in inkjet printheads. It has been developed primarily to improve the lifetime of thermal bend actuators whilst maintaining optimal efficiency.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a nozzle chamber having a nozzle aperture and an actuator for ejecting ink through the nozzle aperture. The design space for inkjet nozzle devices is vast and a plethora of different nozzle devices have been described in the patent literature, including different types of actuators and different device configurations. Inkjet nozzle devices used in commercial printheads typically employ either thermal bubble-forming actuators or piezo actuators. Thermal bubble-forming inkjet devices have the advantages of low-cost and high nozzle density, achievable via MEMS fabrication processes; on the other hand, piezo inkjet devices have the advantage of compatibility with a wide range of inks, such as non-aqueous inks and high viscosity inks.

While inkjet printing technologies have enjoyed considerable commercial success over the past few decades, there remains a need for new inkjet technologies that potentially combine the advantages of thermal bubble-forming and piezo technologies. The Applicant is continuously engaged in research relating to such new inkjet technologies with a focus on MEMS thermal bend actuators as a potential new means for inkjet actuation. A thermal bend actuator uses a thermoelastic layer mechanically cooperating with a passive layer to provide a bending motion via thermal expansion of the thermoelastic layer relative to the passive layer. As described extensively in many of the Applicant's previous patents, the thermally-actuated bending motion of a paddle can be used to provide the requisite mechanical impulse for droplet ejection.

For example, U.S. Pat. No. 6,623,101 (the contents of which are incorporated herein by reference) describes an inkjet nozzle device comprising a nozzle chamber with a moveable roof defining a nozzle opening. The roof is connected via an arm to a thermal bend actuator, having an upper thermoelastic beam and lower passive beam, positioned externally of the nozzle chamber. Upon passing a current through the thermoelastic beam, the moveable roof is caused to bend towards a floor of the nozzle chamber, thereby acting as paddle which increases pressure in the nozzle chamber and ejects an ink droplet through the nozzle opening.

U.S. Pat. No. 7,794,056 (the contents of which are incorporated herein by reference) describes an inkjet nozzle device in which a moveable roof portion of the nozzle chamber incorporates a thermal bend actuator. By incorporating the thermal bend actuator into the moveable roof, greater efficiency is achieved in terms of the energy required for droplet ejection.

The choice of material for the thermoelastic layer in a thermal bend actuator is critical for efficiency as well longevity. For example, U.S. Pat. No. 6,428,133 describes the use of $TiB_2$, $MoSi_2$ and TiAlN as suitable thermoelastic materials. More recently, U.S. Pat. No. 7,984,973 (the contents of which are incorporated herein by reference) describes the use of aluminium alloys for use as thermoelastic materials. Aluminium alloys such as VA1 have the advantages of excellent thermoelastic efficiency as well as manufacturability using deposition processes available in many fabs.

However, in order for thermal bend technology to compete with existing piezo technologies, it is required to have comparable longevity with minimal device failures after many billions of ejections. Accordingly, it would be desirable to provide a thermoelastic material, suitable for use in inkjet nozzle devices, having improved longevity compared to known thermoelastic materials as well as excellent thermoelastic efficiency.

SUMMARY OF THE INVENTION

In a first aspect, there is provided a thermal bend actuator comprising:

a thermoelastic beam for connection to drive circuitry; and a passive beam mechanically cooperating with the thermoelastic beam, such that when a current is passed through the thermoelastic beam, the thermoelastic beam expands relative to the passive beam resulting in bending of the actuator, wherein the thermoelastic beam is comprised of an aluminium alloy, the aluminium alloy comprising a first metal which is aluminium, a second metal, and at least 0.1 at. % of a third metal selected from the group consisting of: copper, scandium, tungsten, molybdenum, chromium, titanium, silicon and magnesium.

Thermal bend actuators according to the first aspect advantageously have superior lifetimes compared to thermal bend actuators comprised of aluminium alloys absent the third metal. Without wishing to be bound by theory, it is understood by the present inventors that the addition of the third metal suppresses electromigration in the thermoelastic beam. This suppression of electromigration is believed to be responsible for the dramatic observed improvements in lifetime. In addition to copper, metals such as scandium, tungsten, molybdenum, chromium, titanium and magnesium are expected to provide comparable improvements in lifetime, based on their ability to suppress electromigration.

For the avoidance of doubt, the first, second and third metals are different than each other.

Preferably, the second metal is selected from the group consisting of: vanadium, titanium, chromium, manganese, cobalt, nickel and scandium.

For the avoidance of the doubt, the second metal may include one or more of the metals listed above. Likewise, the third metal may include one or more of the metals listed above.

Preferably, the second metal is vanadium and the third metal is copper.

Preferably, an amount of aluminium is in the range of 80 to 95% at. %; an amount of second metal is in the range of 2 to 18 at. %; and an amount of third metal is in the range of 0.1 to 5 at. %.

Preferably, the aluminium alloy comprises aluminium, vanadium and copper. In some embodiments the aluminium alloy consists essentially of aluminium, vanadium and copper insofar as these three elements form at least 90% or at least 95% of the alloy.

Preferably, the aluminium alloy comprises aluminium in an amount in the range of 80 to 95% at .%, or preferably 85 to 95 at. %, Preferably, the aluminium alloy comprises the vanadium in an amount in the range of 2 to 18 at. %, or preferably 3 to 15 at. %, or preferably, 7 to 13 at. %. Usually, vanadium is present in an amount of at least 5 at. %.

Preferably, the aluminium alloy comprises copper in an amount in the range of 0.1 to 5 at. %, or preferably 0.15 to 3 at. %, or preferably 0.2 to 1 at. %. Usually, copper is present in an amount of at least 0.1 at. % or at least 0.2 at. %.

The passive beam may be multilayered or monolayered. For example, the passive beam may comprise a first and second layer, each comprised of different materials (e.g. a first layer of silicon nitride and a second layer of silicon oxide, as described in U.S. Pat. No. 8,079,668, the contents of which are incorporated herein by reference). Alternatively, the passive layer may be a single layer of material.

Preferably, the passive beam comprises at least one material selected from the group consisting of: silicon oxide and silicon nitride.

Preferably, the thermoelastic beam is fused or bonded to the passive beam. Typically, the thermoelastic beam material is deposited directly onto the passive beam via a MEMS deposition process (e.g. CVD, PECVD etc.)

Preferably, the passive beam is cantilevered, having one free end and an opposite end connected to a support.

Preferably, thermoelastic beam is connected to a pair of electrical terminals positioned at one end of the passive beam, typically the anchored end connected to the support.

Preferably, the thermoelastic beam comprises a plurality of legs interconnected by one or more turns. For example, the thermoelastic beam may have a first leg extending longitudinally from a first electrical terminal and a second leg extending longitudinally and parallel from a second electrical terminal, the first and second legs being connected by a single turn distal from the electrical terminals. Alternatively, the thermoelastic beam may have a serpentine configuration with, for example, four parallel legs interconnected by three turns. These and other configurations of the thermoelastic beam will be readily apparent to the person skilled in the art.

In a second aspect, there is provided an inkjet nozzle device comprising:

a nozzle chamber having a nozzle opening and an ink inlet; and a thermal bend actuator as described hereinabove.

Preferably, the nozzle chamber comprises a floor and a roof having a moving portion (for example, in the form a paddle), whereby actuation of the actuator moves the moving portion towards said floor.

Preferably, the moving portion comprises the actuator.

Preferably, the nozzle opening is defined in the moving portion, such that the nozzle opening is moveable relative to the floor. Alternatively, the nozzle opening may be defined in a stationary portion of the roof.

In some embodiments, the roof of the nozzle chamber may comprise a plurality of thermal bend actuators for ejecting ink through the nozzle opening. For example, opposed thermal bend actuators at either side of one nozzle opening may be used to generate increased mechanical impulse for droplet ejection.

In a third aspect, there is provided an inkjet printhead comprising a plurality of inkjet nozzle devices as described hereinabove.

As used herein, the term "ink" refers to any ejectable fluid and may include, for example, conventional CMYK inks (e.g. pigment and dye-based inks), infrared inks, UV-curable inks, fixatives, 3D printing fluids, polymers, biological fluids, functional fluids (e.g. sensor inks, solar inks) etc.

For the avoidance of doubt, the term "at. %" refers to an amount of metal in an alloy based on relative numbers of atoms (or moles). For example, an alloy containing V (9.8 at. %), Al (89.9 at. %) and Cu (0.3 at. %) is equivalent to V (17 wt. %), Al (82.5 wt. %) and Cu (0.5 wt. %), as will be readily understood by the person skilled in the art.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
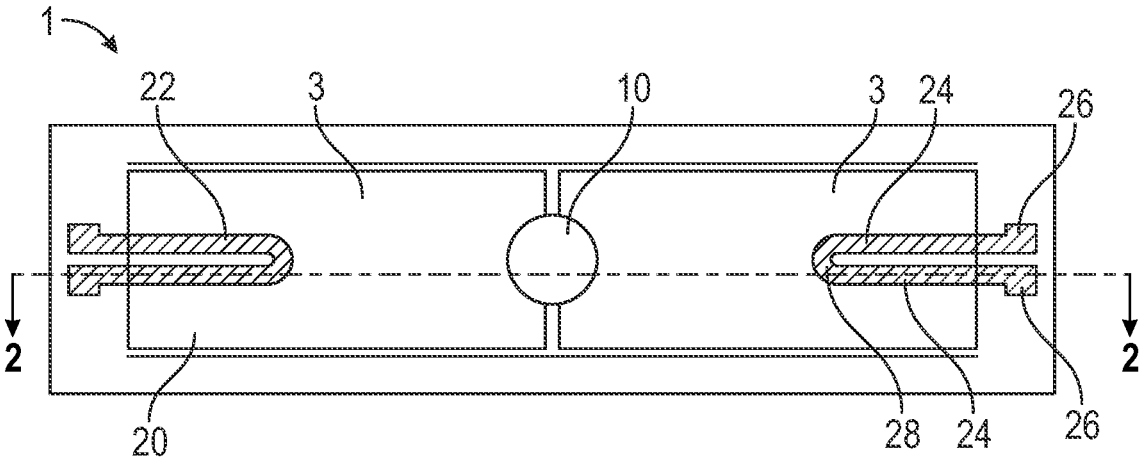
FIG. 1 is a schematic plan view of an inkjet nozzle device comprising thermal bend actuators.
Figure 2:
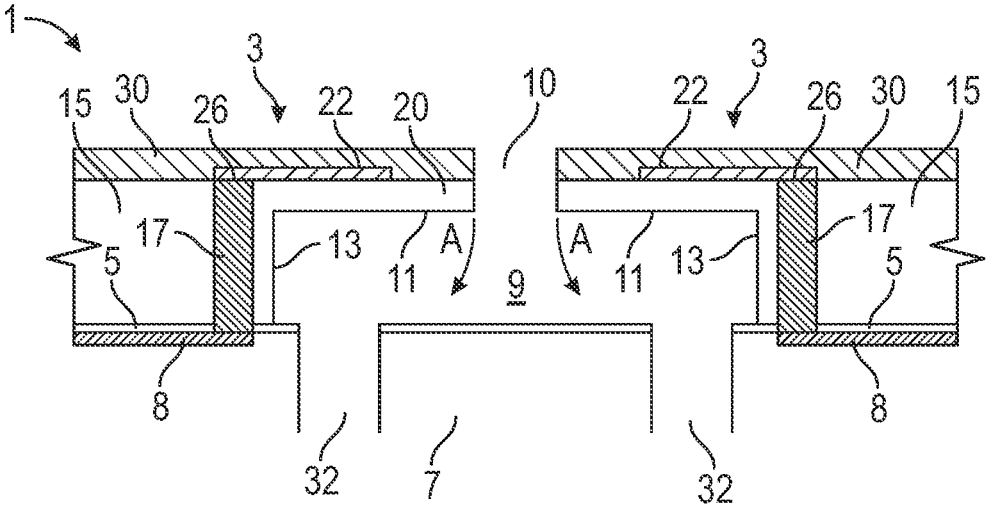
FIG. 2 is a cross-section along line 2-2 of the inkjet nozzle device shown in FIG. 1.

Referring to FIGS. 1 and 2, there is shown an inkjet nozzle device 1 incorporating a pair of opposed thermal bend actuators 3 according to one embodiment of the present invention. Suitable MEMS processes for fabricating nozzle devices of the type shown in FIGS. 1 and 2 are described in the Applicant's US 2008/0309728 and US 2008/0225077, the contents of which are herein incorporated by reference.

The inkjet nozzle device 1 is fabricated on a passivation layer 5 of a silicon substrate 7 having a drive circuitry layer 8 for delivering current pulses to the thermal bend actuators 3. The inkjet nozzle device 1 comprises a nozzle chamber 9 having a nozzle opening 10, a roof 11 and sidewalls 13 extending between the roof and the silicon substrate 7. A blanket silicon oxide layer 15 deposited on the passivation layer 5 defines the sidewalls 13 of the nozzle chamber. Electrical connector posts 17 (e.g. copper posts) formed via a damascene process, as described in U.S. Pat. No. 7,819,503 (the contents of which are incorporated herein by reference), extend through the silicon oxide layer 15 to form an electrical connection to the drive circuitry layer 8 of the silicon substrate 7. As best shown in FIG. 1, a pair of connector posts 17 (power and ground) are provided at an anchored end of each cantilevered thermal bend actuator 3

Each of the thermal bend actuators 3 is comprised of a lower passive beam 20 and an upper thermoelastic ('active') beam 22. Each passive beam 20 is formed via deposition of a suitable passive material onto a sacrificial scaffold (not shown), such that the passive beam at least partially defines the roof 11 of the nozzle chamber 9. In the embodiment shown in FIG. 2, each passive beam 20 is simply a monolayer of silicon oxide, although it will of course be appreciated that multilayered passive beams, as described in U.S. Pat. No. 8,079,668, are within the ambit of the present invention.

Each thermoelastic beam 22 is formed via deposition of a thermoelastic material onto both the passive beam 20 and exposed upper surfaces of the connector posts 17 to thereby form an electrical connection to the drive circuitry layer 8. Etching of the thermoelastic material defines the thermoelastic beams 22, which are each configured as a pair of parallel legs 24 extending from respective power and ground terminals 26 (defined by upper surfaces of the connectors posts 17) towards the nozzle opening 10 and interconnected at respective distal ends by a turn 28. The thermoelastic material is typically a vanadium-aluminum-copper alloy, as will be described in more detail below.

From the foregoing, it will therefore be appreciated that each thermal bend actuator 3 takes the form of a cantilevered paddle, which forms a moving portion of the roof 11 of the nozzle chamber 9. During actuation, the thermoelastic beam 22 of each thermal bend actuator 3 receives an electrical signal from the drive circuitry 8, which cause the thermoelastic beam to expand relative to the passive beam 20, thereby causing each thermal bend actuator to bend downwards towards the silicon substrate 7 in the direction indicated by arrows A. This bending motion increases pressure inside the nozzle chamber 9, thereby causing ejection of an ink droplet through the nozzle opening 10. The circular nozzle opening 10 has a semicircular portion defined in each of thermal bend actuators 3, such that the nozzle moves during actuation. Following droplet ejection, ink is replenished in the nozzle chamber via a pair of ink inlets 32, which receive ink from ink supply channels (not shown) defined in the silicon substrate.

As shown in FIG. 2, a polymer layer 30 (e.g. polyimide layer) is superposed on the entire structure, including exposed portions of the passive beam and the thermoelastic beam, so as to protect the thermal bend actuators 3 from ink and to provide thermal insulation. The polymer layer 30 may include a dewetting coating (e.g. hydrophobic and/or oleophobic coating) to assist in preventing flooding and encourage stable droplet ejection. For clarity, the polymer layer 30 is not shown in FIG. 1.

Figure 3:
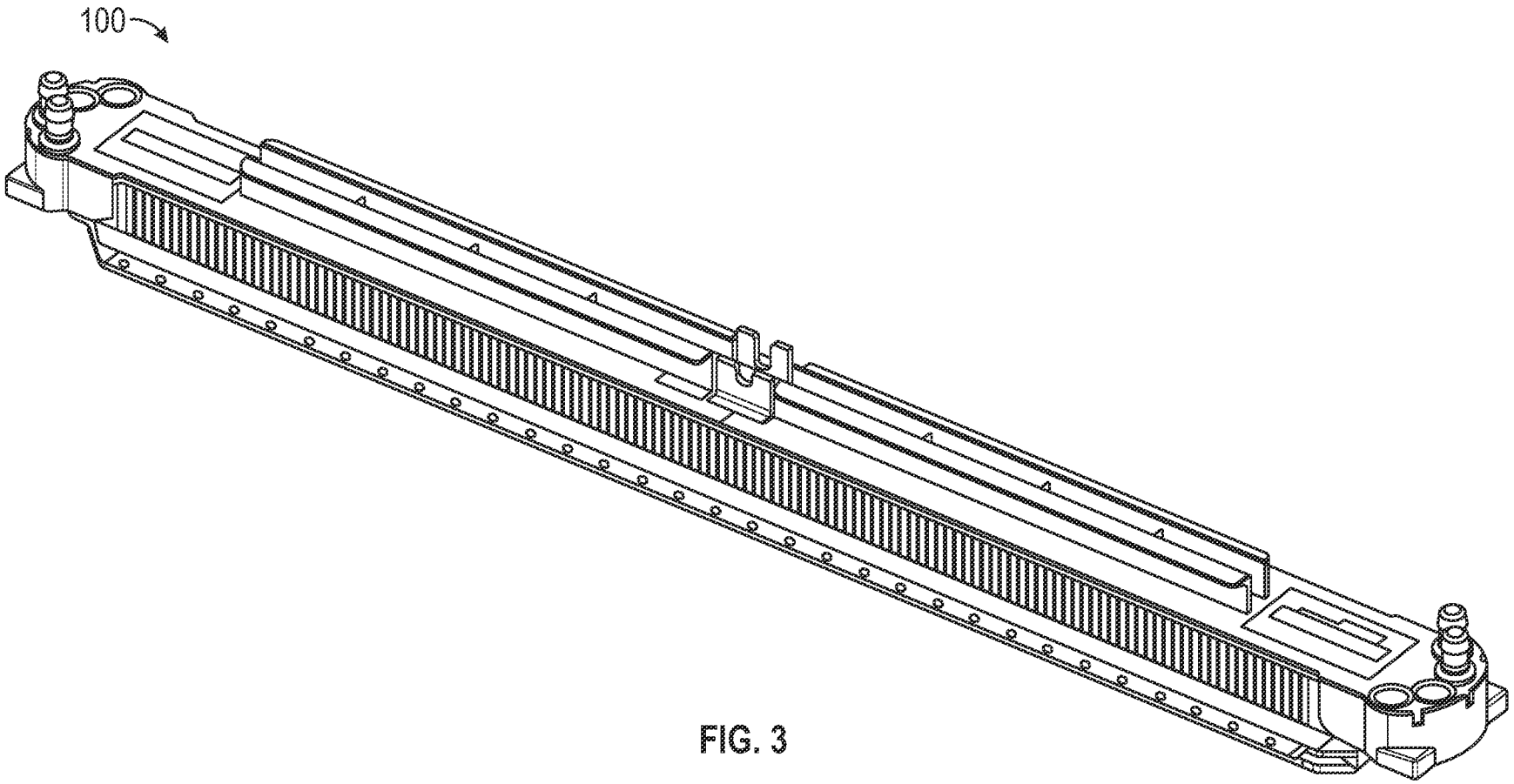
FIG. 3 is a perspective of a portion of an inkjet printhead comprising a plurality of the inkjet nozzle devices shown in FIG. 1.

FIG. 3 shows an example of a pagewide inkjet printhead 100 incorporating MEMS inkjet nozzle devices 1, as described above.

Improved Thermoelastic Material

As described in U.S. Pat. No. 7,984,973, aluminium alloys are excellent candidates for use as the thermoelastic beam in thermal bend actuators, combining the properties of relatively high thermal expansion and a relatively high modulus of elasticity compared to other known thermoelastic materials. For example, vanadium-aluminium and titanium-aluminium alloys have been used by the present Applicant in the development of inkjet nozzle devices employing thermal bend actuation technology.

However, there remains a need to improve the longevity of thermal bend actuators, whilst maintaining the above-mentioned desirable properties of aluminium alloys. Following an extensive review of materials and device configurations, it has now been found that the addition of small amounts of copper (e.g. up to about 5 at. %) to aluminium alloys dramatically improves longevity without compromising performance Table 1 shows the performance of two aluminium alloys used as the thermoelastic material in otherwise identical inkjet nozzle devices 1 of the type described above in connection with FIGS. 1 and 2. One aluminium alloy ("VA1") consists of 90 at. % Al and 10 at. % V; the other aluminium alloy ("VAlCu") consists of 89.9 at. % Al, 9.8 at. % V and 0.3 at. % Cu.

TABLE 1

Comparison of VAI and VAICu as thermoelastic materials

| Measurement | VAI | VAICu |
|---|---|---|
| Energy input (nJ) | 698 | 696 |
| Current density (A/m$^2$) | 5.73 | 5.71 |
| Nozzles alive after 6.2 billion actuations | 17% | 93% |
| Thermal bend response-heating to 180° C. (MPa/° C.) | −2.33 | −2.31 |
| Thermal bend response-cooling from 180° C. (MPa/° C.) | −2.61 | −2.64 |
| Maximum velocity during free air oscillation (m/s) | ca. −2.5 | ca. −2.5 |

The results in Table 1 clearly demonstrate that the addition of copper to an aluminum alloy produces a surprising improvement in longevity. With a similar energy input and current density, a mere 17% of the devices having a VA1 thermoelastic beam were still alive and actuating after about 6 billion actuations, whereas 93% of the devices having a VAlCu thermoelastic beam were still alive after the same number of actuations. This represents a remarkable and surprising fivefold improvement in lifetime.

Furthermore, the performances of both thermal bend actuators were very similar in terms of their thermal bend response and maximum velocity during free air oscillation. Therefore, the addition of copper, whilst dramatically improving longevity, made negligible difference in terms of device performance. It was therefore concluded that aluminum alloys containing small amounts of copper were optimal for overall device performance and longevity.

It will, of course, be appreciated that the present invention has been described by way of example only and that modifications of detail may be made within the scope of the invention, which is defined in the accompanying claims.

The invention claimed is:

1. A thermal bend actuator comprising:

a thermoelastic beam for connection to drive circuitry; and a passive beam mechanically cooperating with the thermoelastic beam, such that when a current is passed through the thermoelastic beam, the thermoelastic beam expands relative to the passive beam resulting in bending of the actuator, wherein the thermoelastic beam is comprised of an aluminium alloy, the aluminium alloy comprising a first metal which is aluminium, a second metal, and at least 0.1 at. % of a third metal selected from the group consisting of: copper, scandium, tungsten, molybdenum, chromium, titanium, magnesium and silicon.

2. The thermal bend actuator of claim 1, wherein the second metal is selected from the group consisting of: vanadium, titanium, chromium, manganese, cobalt, nickel and scandium.

3. The thermal bend actuator of claim 1, wherein the second metal is vanadium.

4. The thermal bend actuator of claim 1, wherein the third metal is copper.

5. The thermal bend actuator of claim 1, wherein:

an amount of aluminium is in the range of 80 to 95% at. %;

an amount of the second metal is in the range of 2 to 18 at. %; and an amount of the third metal is in the range of 0.1 to 5 at. %.

6. The thermal bend actuator of claim 1, wherein the passive beam is multilayered or monolayered.

7. The thermal bend actuator of claim 6, wherein the passive beam comprises at least one material selected from the group consisting of: silicon oxide and silicon nitride.

8. The thermal bend actuator of claim 1, wherein the thermoelastic beam is fused or bonded to the passive beam.

9. The thermal bend actuator of claim 1, wherein the passive beam is cantilevered.

10. The thermal bend actuator claim 9, wherein the thermoelastic beam is connected to a pair of electrical terminals positioned at one end of the passive beam.

11. The thermal bend actuator of claim 10, wherein the thermoelastic beam comprises a plurality of legs interconnected by one or more turns.

12. An inkjet nozzle device comprising:

a nozzle chamber having a nozzle opening and an ink inlet; and a thermal bend actuator for ejecting ink through the nozzle opening, said actuator comprising:

a thermoelastic beam connected to drive circuitry; and a passive beam mechanically cooperating with the thermoelastic beam, such that when a current is passed through the thermoelastic beam, the thermoelastic beam expands relative to the passive beam resulting in bending of the actuator, wherein the thermoelastic beam is comprised of an aluminium alloy having at least 0.1 at. % copper.

13. The inkjet nozzle device of claim 12, wherein the nozzle chamber comprises a floor and a roof having a moving portion, whereby actuation of said actuator moves said moving portion towards said floor.

14. The inkjet nozzle device of claim 13, wherein the moving portion comprises the actuator.

15. The inkjet nozzle device of claim 14, wherein the nozzle opening is defined in the moving portion, such that the nozzle opening is moveable relative to the floor.

16. The inkjet nozzle device of claim 12 comprising a plurality of thermal bend actuators for ejecting ink through the nozzle opening.

17. An inkjet printhead comprising a plurality of inkjet nozzle devices according to claim 12.

* * * * *